United States Patent [19]

Santoro

[11] Patent Number: 4,934,693

[45] Date of Patent: Jun. 19, 1990

[54] MULTI-EXERCISE FREE WEIGHT APPARATUS

[76] Inventor: John G. Santoro, 1900 Dant Blvd., Reno, Nev. 89509

[21] Appl. No.: 285,636

[22] Filed: Dec. 16, 1988

[51] Int. Cl.[5] ..... A63B 13/00

[52] U.S. Cl. ..... 272/123; 272/117

[58] Field of Search ..... 272/117, 118, 123, 144

[56] References Cited

U.S. PATENT DOCUMENTS

| | | | |
|---|---|---|---|
| 3,207,511 | 9/1965 | Hoffman | 272/117 X |
| 3,235,255 | 2/1966 | Leflar | 272/123 |
| 3,346,256 | 10/1967 | White | 272/118 |
| 4,153,244 | 5/1979 | Tauber, Jr. | 272/117 |
| 4,252,314 | 2/1981 | Ceppo | 272/117 |
| 4,256,301 | 3/1981 | Goyette | 272/123 |
| 4,262,901 | 4/1981 | Faust | 272/117 |
| 4,420,154 | 12/1983 | Ramsey et al. | 272/118 |
| 4,441,706 | 4/1984 | Korzaniewski | 272/118 |
| 4,527,797 | 7/1985 | Slade, Jr. et al. | 272/118 X |
| 4,540,171 | 9/1985 | Clark et al. | 272/123 X |
| 4,561,651 | 12/1985 | Hole | 272/123 |
| 4,564,194 | 1/1986 | Dawson | 272/123 |
| 4,700,944 | 10/1987 | Sterba | 272/117 |

FOREIGN PATENT DOCUMENTS

| | | | |
|---|---|---|---|
| 3528994 | 2/1987 | Fed. Rep. of Germany | 272/123 |

*Primary Examiner*—Richard J. Apley
*Assistant Examiner*—Robert W. Bahr

[57] ABSTRACT

A multi-exercise free weight exercise apparatus for preventing injury to a weight lifter from a weight bearing bar and weights thereon in the event the weight lifter is unable to complete another repetition of the exercise due to any circumstance. The weightlifting apparatus consists of a framework having a pair of bases, pair of upright support members, pair of guide sleeve assemblies, and pairs of parallel vertical guide track support members with a plurality of apertures. The guide sleeve assemblies each have oversized holes through the centers of their sides for inserting a weight bearing bar and also pairs of oversized holes located near each end of their top and bottom for insertion of the pairs of vertical guide track support members. To perform a particular exercise a pair of safety stop keys are inserted into the apertures of the vertical guide track support members, at a predetermined height below the guide sleeve assemblies, in order to prevent downward movement of the guide sleeve assemblies and weight bar beyond this height thereby preventing injury to the weight lifter. During any upward or downward movement the weight bar can be rotated in order to reduce stress on the weight lifter's wrist, elbow and shoulder joints resulting from the defined vertical track created by the vertical guide track support members. This apparatus also allows the use of weight bearing bars of different diameters and the use of a detachable sleeve over the weight bar for increasing grip size.

8 Claims, 11 Drawing Sheets

MULTI-EXERCISE FREE WEIGHT APPARATUS

FIELD OF THE INVENTION

This invention relates generally to an improved, relatively simple in construction weightlifting apparatus. More specifically to a multi-purpose weightlifting system facilitating the performance of various exercises with a single apparatus and a method for preventing injury to a weight lifter during performance of various exercises.

BACKGROUND OF THE INVENTION

Exercising apparatus and equipment have been developed to provide various multi-function types of exercises. In the prior art various weightlifting equipment have been disclosed including those referenced in the following U.S. Patents:

U.S. Pat. No. 4,252,314 to L. Ceppo, a weightlifting device is disclosed including two upright members, a weight carrying bar coupled to cylindrical members, in a frame having several uprights. The cylindrical members and upright members guide the weightlifting bar in vertical movements. The weightlifting bar is not rotatable during vertical lifting to reduce strain on the wrist, elbow and shoulder joints during any exercise. Also the vertical upright members are not adjustable in height to perform exercises which require additional height for the cylindrical members to travel a greater vertical distance.

U.S. Pat. No. 4,564,194 to Dawson, a weightlifting station is disclosed including a pair of guide posts, a barbell assembly, a sleeve telescoped over the weight bar and stop pins attached to the sleeve, where during rotation of the sleeve the stop pins can pivotally engage the guide posts through holes provided along the length of the guide posts. The rotation of the sleeve during vertical lifting of the barbell assembly to reduce stress on the wrist, elbow and shoulder joints will cause the stop pins to prematurely engage the holes in the guide posts and prevent the complete vertical lifting of the barbell assembly. Also, the weightlifting bar is not rotatable during vertical lifting to reduce pressure on the wrist, elbow and shoulder joints when performing any exercise. The vertical support posts are not adjustable to provide additional height for those exercises that require the clamping member to travel a greater vertical distance.

U.S. Pat. No. 3,346,256 to White, disclosed a device comprised of a guided sleeve assembly, connected together by a horizontal bar, guidably supported on a pair of parallel vertical uprights. A safety clamping collar is provided to stop the movement of the bar in a downward direction. If the weight bar is dropped it will go as far as the pre-selected position of the collar. The weightlifting bar is not rotatable to reduce pressure on the wrist, elbow and shoulder joints when performing any exercise. The vertical uprights are not adjustable in height to perform exercises which require additional height for the clamping collars to travel a greater vertical distance.

U.S. Pat. No. 4,153,244 to Tauber Jr. disclosed a gymnasium type equipment consisting of a weight bar attached to a pair of slides that are supported on vertical posts for performing vertical lifting exercises of the weight bar. Strap pins are used to limit the downward movement of the weight on the vertical slide posts. The weightlifting bar is not rotatable to reduce stress on the wrist, elbow and shoulder joints when performing any exercise.

None of the above or any multifunction weightlifting system known allows the rotation of the weight bearing bar, the use of weight bearing bars of various diameters, the removal of the weight bearing bar from slider assemblies, the use of a detachable barbell sleeve over the weight bearing bar and provides the versatility and safety advantages of this particular weightlifting apparatus.

SUMMARY OF THE INVENTION

A principal object of the invention is to provide a multi-function free weight exercise apparatus for preventing injury to a weight lifter from the crashing down of a weight bearing bar having weight plates there-on in the event of physical exhaustion of the weight lifter during any exercise.

Another object is the ability to rotate the weight bearing bar with plates there-on during any exercise in order to reduce the stress on wrist, elbow and shoulder joints during an exercise.

A further object is to provide detachable guided sleeve assemblies which have a weight bearing bar inserted through holes in the center of both sides of the pair of guided sleeve assemblies and also the insertion of the pair of vertical guide track support members through two holes near the ends of the top and bottom of each of the guide sleeve assemblies in order to contain the weight bearing bar and provide control over the vertical path that the weight bearing bar and guide sleeve assemblies travel during any exercise.

It is a further object of the invention to allow the insertion of various diameter sizes of weight bearing bars through the holes in the center of both sides of the pair of guided sleeve assemblies.

Another object of this invention is to allow the placement of a larger sized barbell sleeve over the weight bearing bar in the area where the weight lifter places his hands for gripping the bar in order to perform an exercise thereby increasing his grip size for increased development of his forearm muscles and also the strengthening of his grip.

Still a further object is the use of the pair of guide sleeve assemblies to prevent the weight bearing bar from tilting during any upward or downward vertical movement of an exercise.

A still further object is to have the weight bearing bar inserted through a hole in the exact center of both sides of the pairs of guide sleeve assemblies in order to prevent the binding of the guide sleeve assemblies against the vertical guide track support members during any exercise.

A further object is to provide an increase or decrease in the height of the pairs of vertical guide track support members by placement of safety stop keys into the holes of the pair of vertical guide track support members at the desired height of the support members.

A still further object is to provide a multi-function free weight apparatus which is durable, compact, safe, prevents injury to the weight lifter, easy to assemble and disassemble and which provides considerable versatility for performing free weight type lifting exercises.

BRIEF DESCRIPTION OF THE DRAWINGS

The above objects and features of the invention will become more readily apparent with reference to the following detailed description including the drawings in which like reference numerals refer to like parts.

DESCRIPTION OF THE PREFERRED EMBODIMENT

A principal feature of the invention resides in a safety device in the form of auxiliary means for supporting a weight bearing bar should, during exercising, the weight lifter be too exhausted to complete an exercise and have the weight bearing bar crash down on the exerciser.

Figure 1:
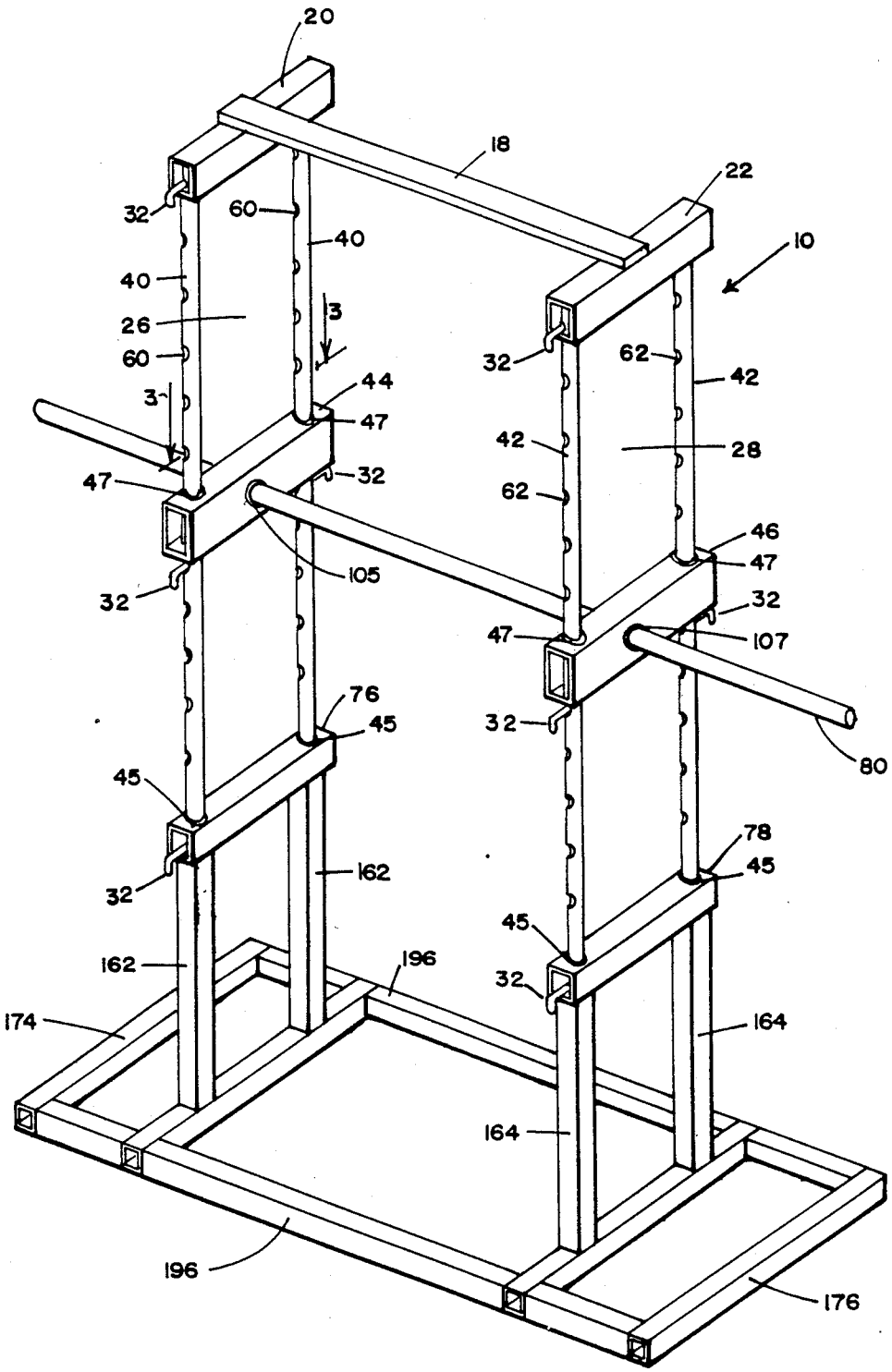
FIG. 1 is a perspective view of the preferred embodiment of the invention.
Figure 2:
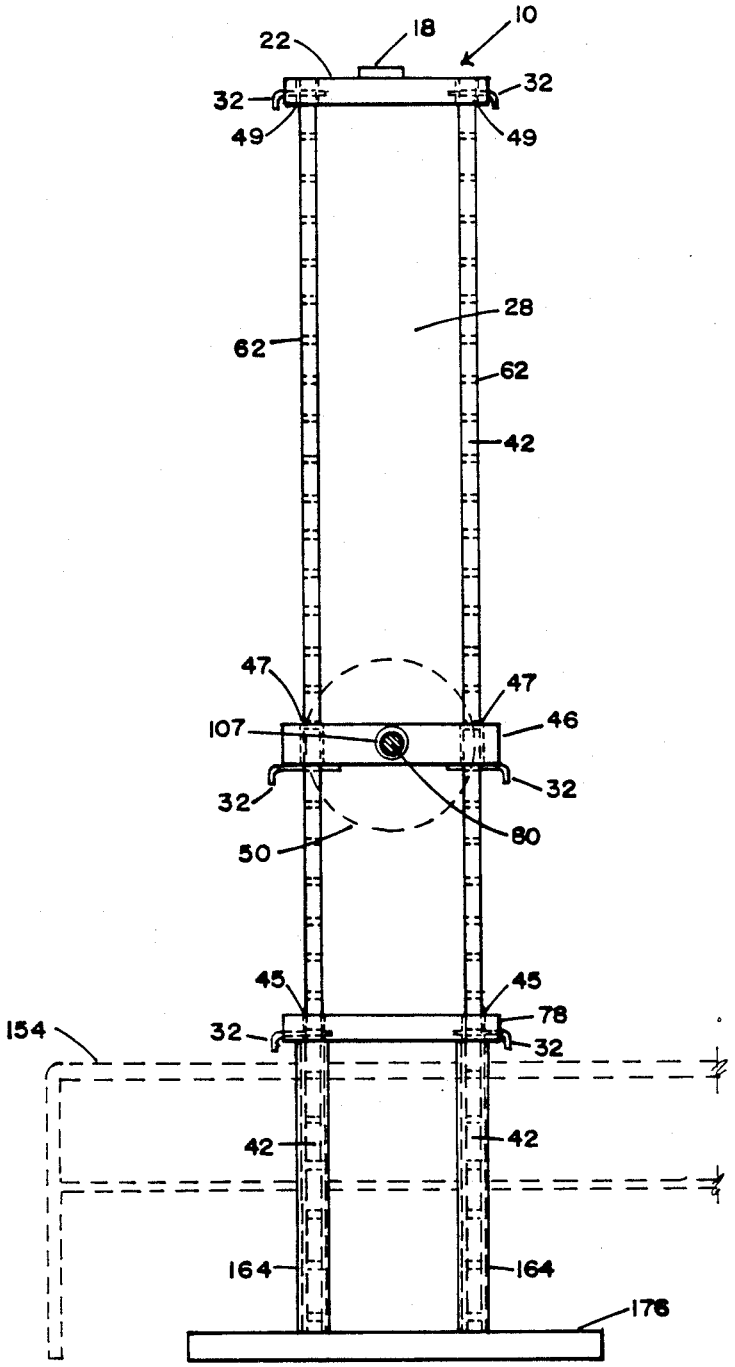
FIG. 2 is a side elevational view of the invention.
Figure 3:
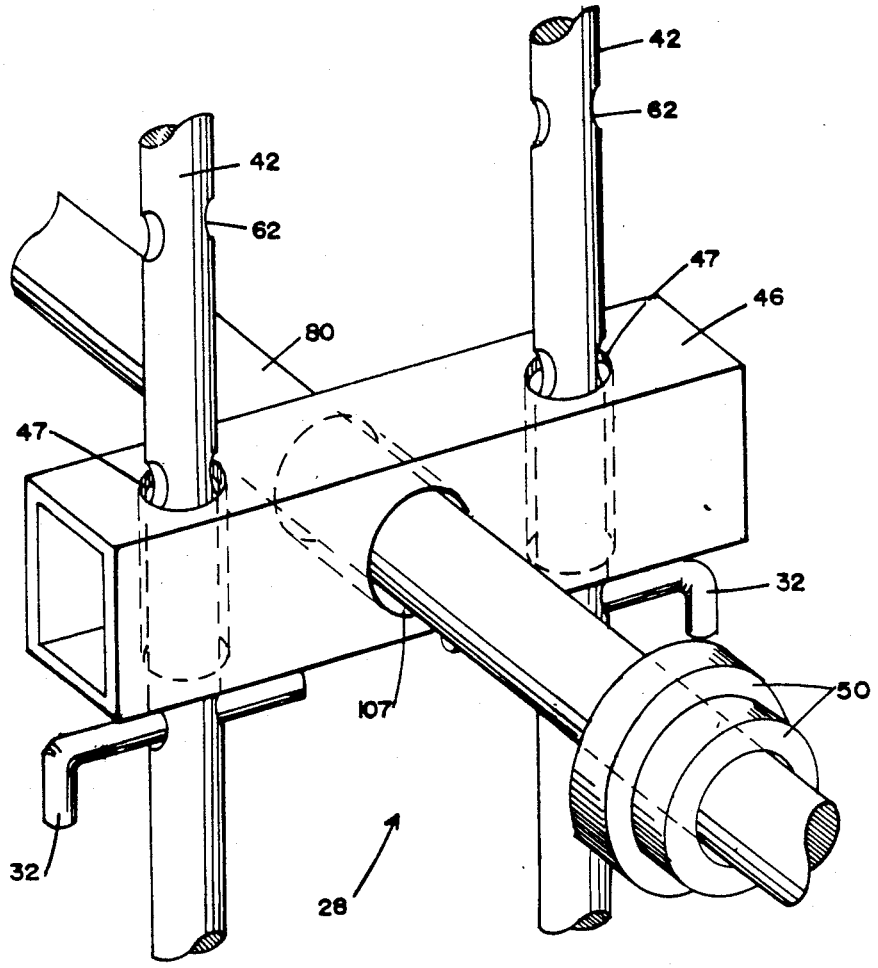
FIG. 3 is an enlarged fragmentary perspective illustrating the guide sleeve assembly with the weight bearing bar and removable safety stop keys engaging the vertical guide track support member taken partly along the plane of line 7—7 FIG. 9.
Figure 4:
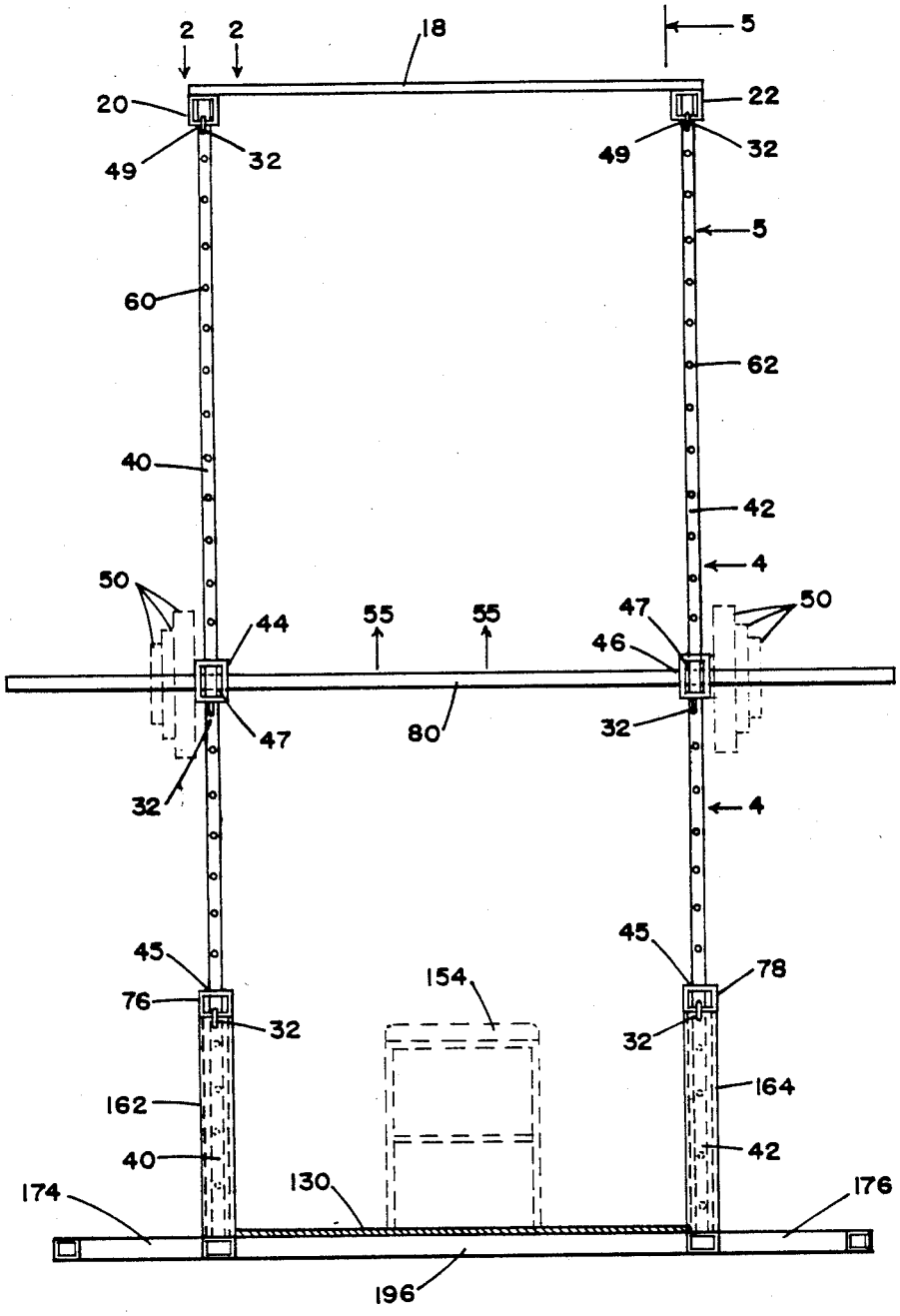
FIG. 4 is a front elevational view of the weightlifting apparatus.
Figure 5:
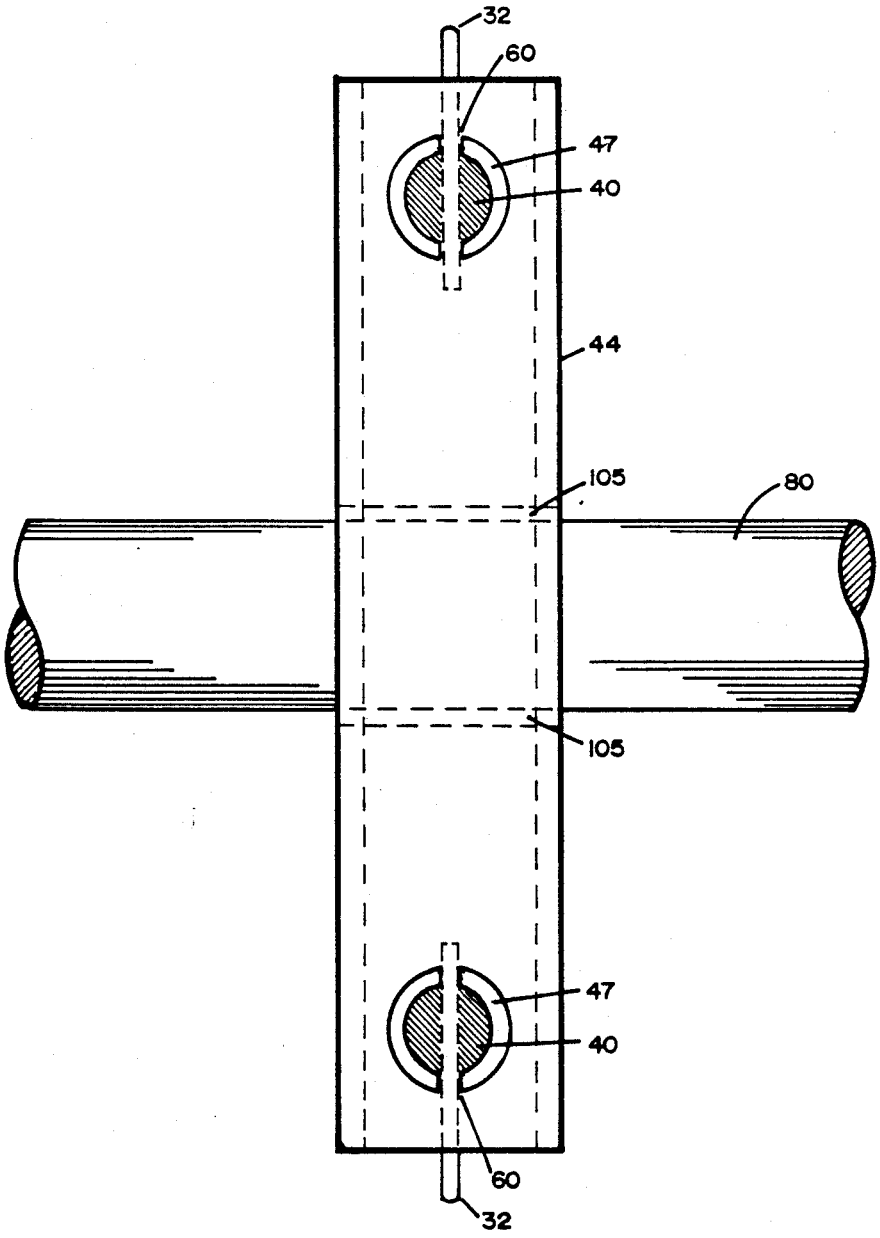
FIG. 5 is an enlarged horizontal section of the guide sleeve assembly on the line 3—3 FIG. 1.
Figure 6:
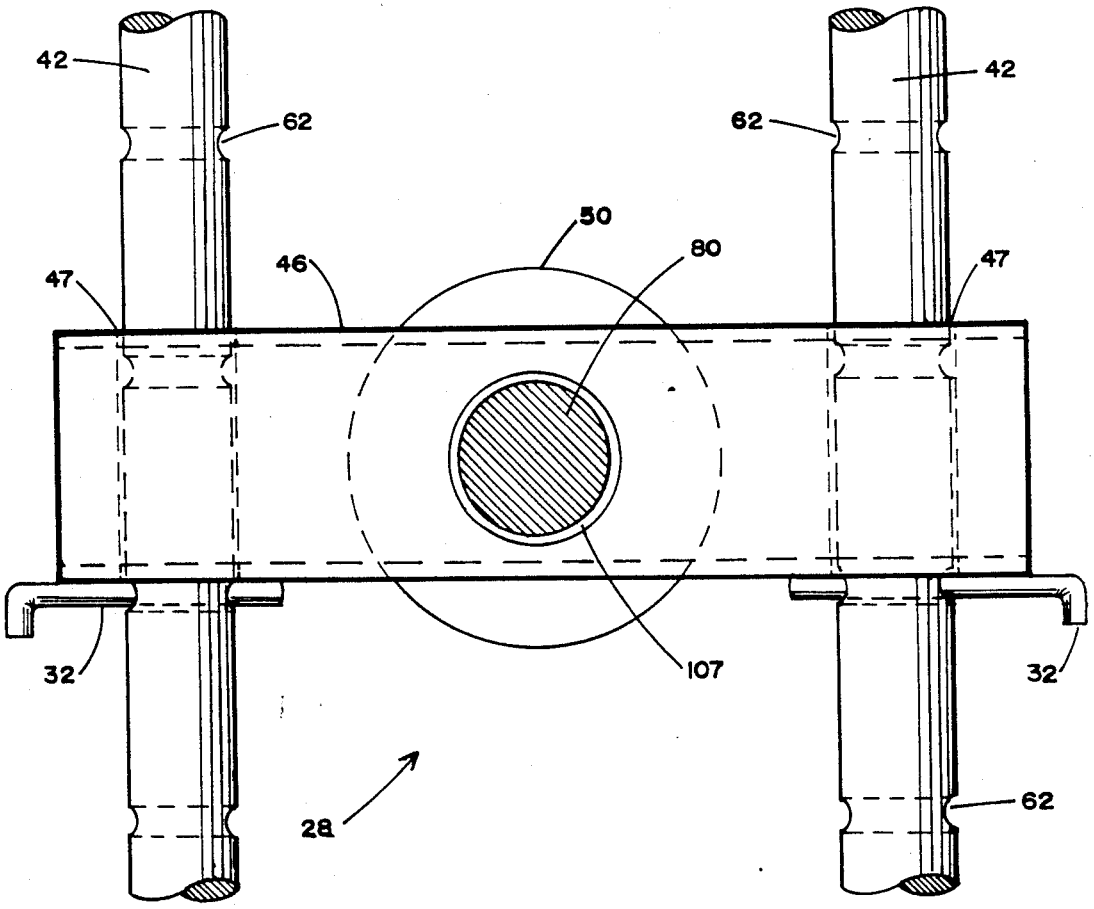
FIG. 6 is an enlarged cross-sectional view of the guide sleeve assembly taken partly along the section plane of line 4—4 FIG. 4.
Figure 7:
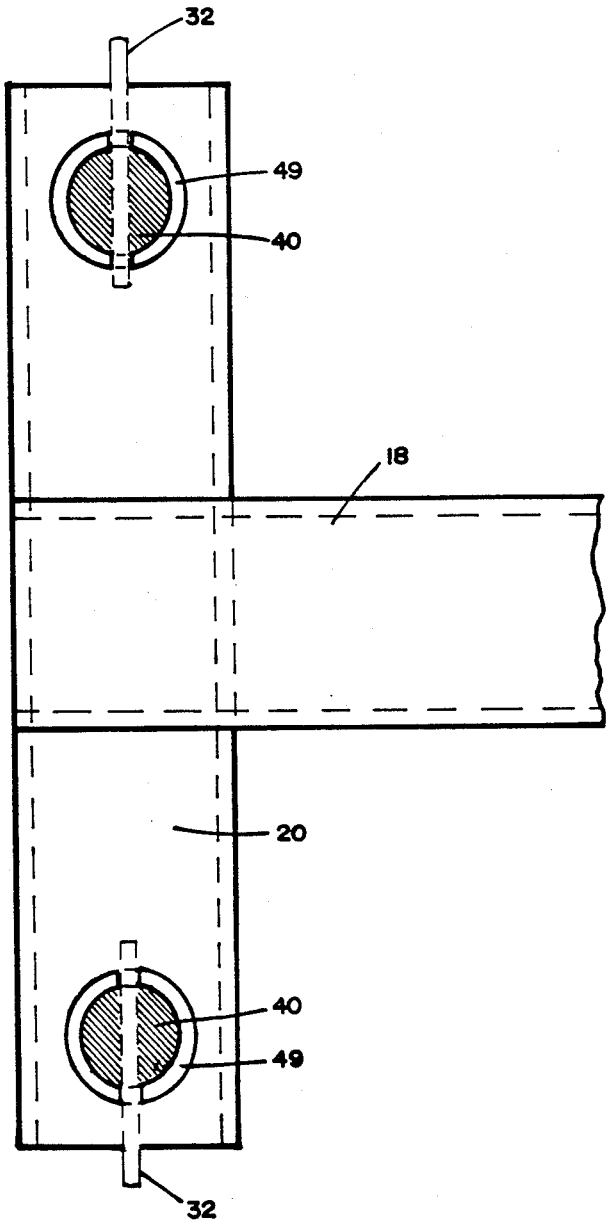
FIG. 7 is an enlarged partial horizontal section view of the upper support member taken along the plane line 2—2 FIG. 4.
Figure 8:
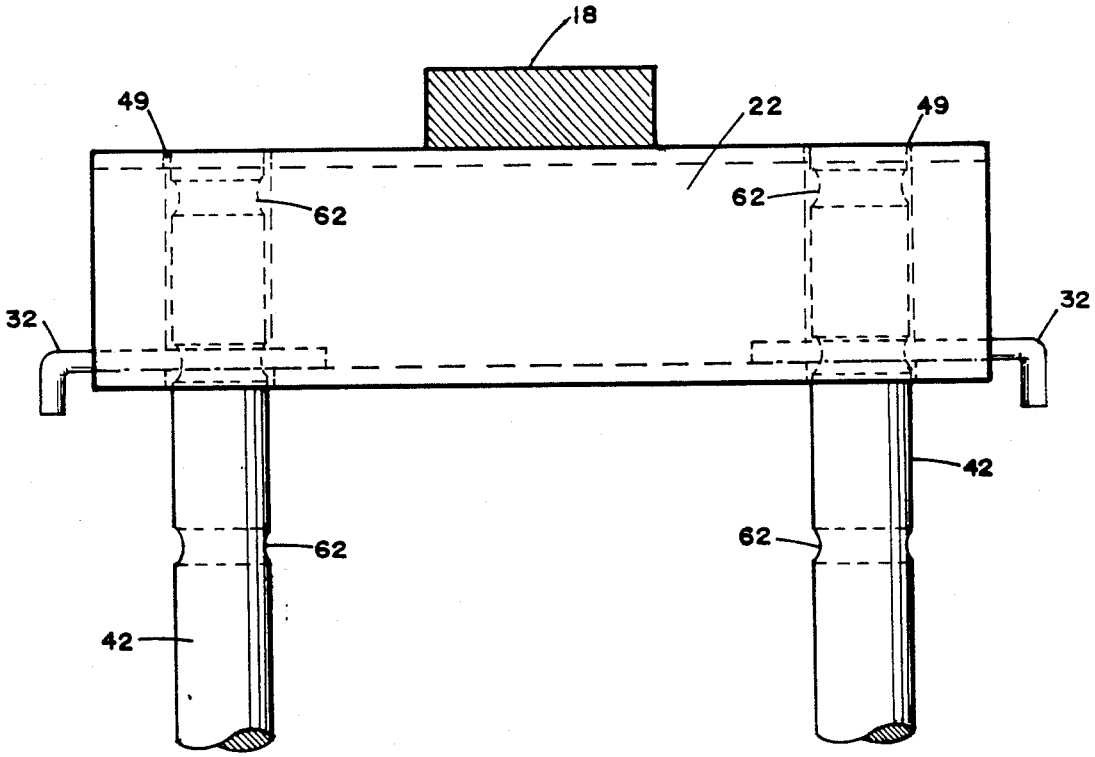
FIG. 8 is an enlarged partial vertical sectional view of the upper support member taken partly along the plane of line 5—5 FIG. 4.

Referring in detail now to the drawings and particularly FIG. 1 wherein like reference numerals designate similar parts throughout the various views, the free weight exercising apparatus of the present invention is designated by reference numeral 10 for preventing injury to a weight lifter from a weight bearing bar 80, having weights 50 on each end in the event of physical exhaustion of the weight lifter; and for closely adjusting the height of the weight bearing bar 80 relative to a weight lifter on a (dotted line) bench 154 as shown in FIG. 2 and FIG. 4. The weightlifting apparatus 10 as shown in FIG. 1 has a pair of bases 174 and 176, a pair of upright brace support members 162 and 164 a pair of lower transverse bars 196, a pair of longitudinally extending upper support members 20 and 22 with an upper transverse bar 18 connected to the center of the upper support members 20 and 22, a pair of longitudinally extending lower support members 76 and 78 which are welded to the upper ends of the pair of upright brace support members 162 and 164 whose lower ends are welded to the pair of bases 174 and 176 respectively and a pair of longitudinally extending movable guide sleeve assemblies 44 and 46. A first pair of vertical guide track support members 40—40 is inserted into the pair of holes 45 near the ends of the lower support member 76 and thereto through the channels in the pair of upright brace support members 162. A second pair of vertical guide track support members 42—42 is inserted into the pair of holes 45 near the ends of the lower support member 78 and thereto through the channels in the pair of upright base support members 164. As shown in FIG. 1, and FIG. 5 a first movable guide sleeve assembly 44 is inserted over the first pair of vertical guide track support members 40—40 through the pair of holes 47 near the ends of the guide sleeve assembly 44. FIG. 1, FIG. 3 and FIG. 6 show a second movable guide sleeve assembly 46 is inserted over the second pair of vertical guide track support members 42—42 through the pair of holes 47 near the ends of the guide sleeve assembly 46. As shown in FIG. 4 and FIG. 7 the first longitudinally extending upper support member 20 is inserted over the first pair of vertical guide track support members 40—40 into the pair of holes 49 near the ends of the upper support member 20. FIG. 4 and FIG. 8 show the second longitudinally extending upper support member 22 is inserted over the second pair of vertical guide track support members 42—42 into the pair of holes 49 near the ends of the upper support member 22. Referring now to FIG. 1, the first pair of vertical guide track support members 40—40 and the second pair of vertical guide track support members 42—42 are positioned in proximity to each other such as to create a first slot 26 and a second slot 28 respectively. As shown in FIG. 1 and FIG. 4 a first pair of vertical guide track support members 40—40 and the second pair of vertical guide track support members 42—42 respectively, have a uniform, coaxially aligned vertical series of holes 60 and 62 transversely through the vertical support members 40—40 and 42—42, the holes 60 in the first pair of vertical guide track support members 40—40 being in coaxial alignment and the holes 62 in the second pair of vertical guide track support members 42—42 correspondingly and similarly being in coaxial alignment. Illustrated in FIG. 1 the generally hollow rectangular guide sleeve assemblies 44 and 46 are slidably and adjustably mounted within the first slot 26 and within the second slot 28 respectively. The guide sleeve assemblies 44 and 46 support the weight bearing bar 80 which is inserted through the holes 105 and 107 in the sides of the guide sleeve assemblies 44 and 46 respectively. The guide sleeve assemblies are capable of being adjusted to a predetermined height by the weight lifter by use of safety stop keys 32 slidably inserted through the holes 60—60 in the first pair of vertical guide track support members 40—40 and through the holes 62—62 in the second pair of vertical guide track support members 42—42 (see FIG. 1, FIG. 2 and FIG. 4).

This structure represents the basic framework structure and these components are constructed of materials having the necessary size and strength capabilities for use as a free weight exercising apparatus. As shown in FIG. 4, if desired the pair of base members 174 and 176 may be anchored to the pair of lower transverse members 196 or a plywood or other material platform 130 as a supporting surface. The framework components may be rigidly fixed together as by welding, bolts, rivets and the like. Usually it is desirable for the pair of upright brace support members 162 and 164 to be welded to the pair of base members 174 and 176 and the pair of lower longitudinally extending support members 76 and 78 respectively. It is also usually desirable to have the pair of upper longitudinally support members 20 and 22 to be welded to the upper transverse bar 18.

As understood, the weightlifting exercises such as bench presses, squats, military presses, pulldowns and other exercises are performed by the weight lifter forcing the weight bearing bar in an ascending movement using his arms or legs, said movement of the weight bearing bar 80 and weights 50 being along a vertical path defined by the pairs of vertical guide track support members 40—40 and 42—42 and the pair of guide sleeve assemblies 44 and 46. For completeness sake, it should be noted that the starting position for the weight bearing bar 80 and the guide sleeve assemblies 44 and 46 in relation to the vertical guide track support members 40—40 and 42—42 is determined by safety stop keys 32 of well known construction inserted into predetermined coaxially aligned holes 60 and 62 of the vertical guide track support members 40—40 and 42—42 respectively. That is, safety stop keys 32 support the guide sleeve assemblies 44 and 46 which guide the weight bearing bar 80 and the exercise weights 50 in the full line starting position illustrated in FIG. 2 and FIG. 4 from which position the weight lifter presses the weights in ascending movements to an elevated position, then controls the descent thereof against the safety stop keys 32 and makes a selected number of these alternating and descending movements in accordance with his weightlifting exercise routine.

In use, a weight lifter, after determining the type of exercise, positions the guide sleeve assemblies 44 and 46 at the desired height by inserting the safety stop keys 32 into the coaxially aligned holes 60 and 62, of the pairs of vertical guide track support members 40—40 and 42—42 respectively, which are directly below the underside of the guide sleeve assemblies 44 and 46 respectively. In FIG. 2 and FIG. 4 the guide sleeve assemblies 44 and 46 are shown located in a raised position for the bench press. The weight lifter positions the bench (dotted lines) so that the head end of the bench is properly located under the weight bearing bar 80 which has been inserted through the holes 105 and 107 in the center of the sides of the guide sleeve assemblies 44 and 46 respectively. In the perspectives of FIG. 2 and FIG. 4 the selected exercise weights shown with phantom lines thereof and designated 50, are appropriately mounted near the ends of the weight bearing bar 80. As understood, the bench press is performed by the weight lifter lying on his back on the bench. He then is able, with outstretched arms, to raise the weight bearing bar 80 and the guide sleeve assemblies 44 and 46 slidably in ascending movements 55 off the safety stop keys 32 in an elevated position along the vertical path defined by the pair of vertical guide track support members 40—40 and 42—42, then controls the descent of the weight bearing bar 80 and the guide sleeve assemblies 44 and 46 thereof against the safety stop keys 32. The weight lifter makes a number of these ascending and descending movements in accordance with his weight-lifting exercise routine. During the ascending and descending movements the weight lifter has the ability to safely and easily rotate the weight bearing bar 80 since it is free to turn within the oversized holes 105 and 107 of the guide sleeve assemblies 44 and 46. (See FIG. 1, FIG. 2, FIG. 3 and FIG. 5.) This rotation changes the angle of the wrist, elbow and shoulder joints during the ascending and descending movements therefore reducing the stress in these joints. In other known weightlifting apparatus a weight bearing bar is appropriately affixed, as by welding or the like to a cylindrical or other shaped members inserted over upright guide tracks to provide a sliding movement of the weight bearing bar in a fixed vertical path. The weight bearing bar is pressed upward or lowered in a straight, fixed upward and downward path which locks the wrist, elbow and shoulder joints into an unnatural position and which places great stress on these joints and can cause injuries to the joints.

Figure 9:
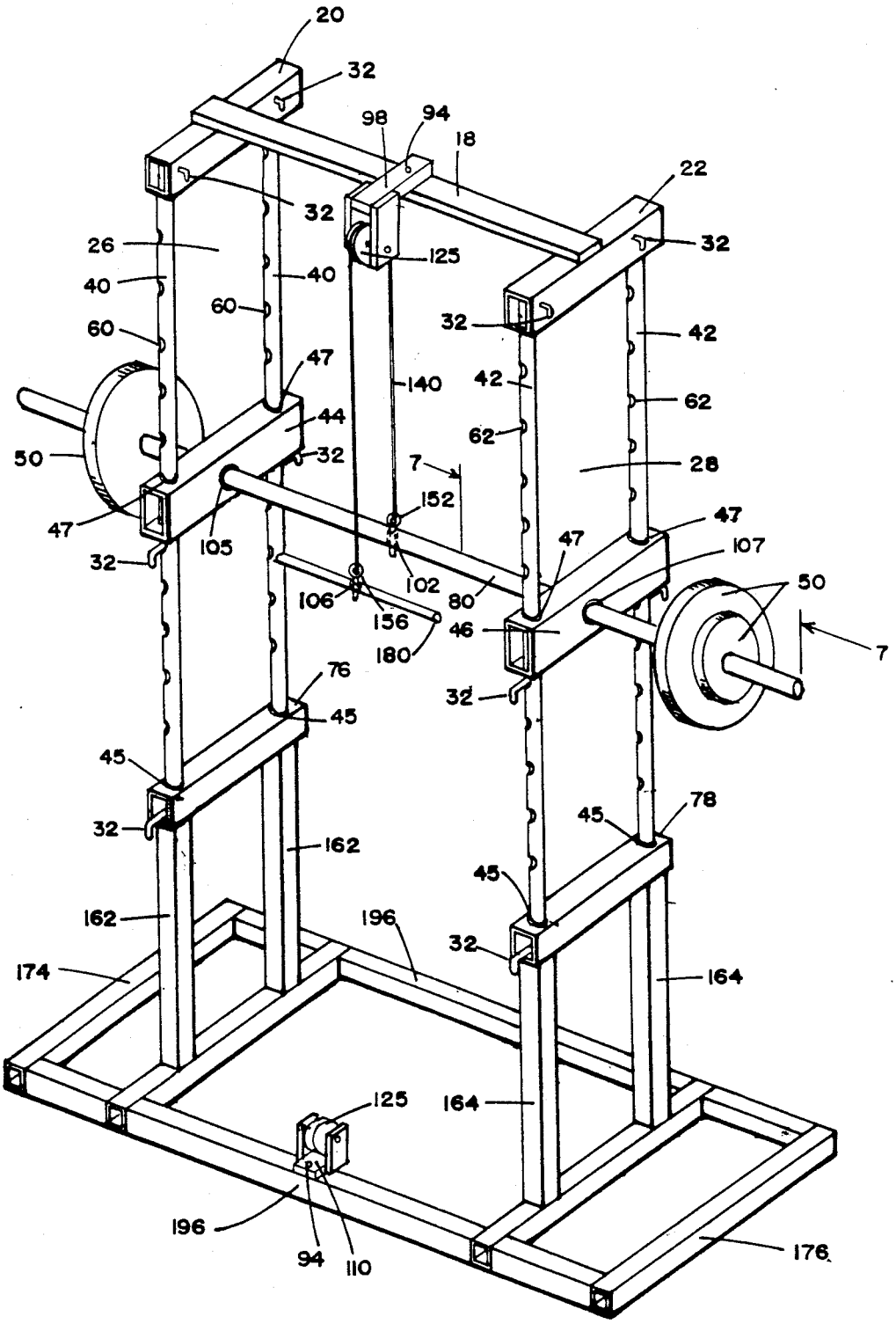
FIG. 9 is a perspective view of a second embodiment of the invention including pulleys for additional exercises.
Figure 10:
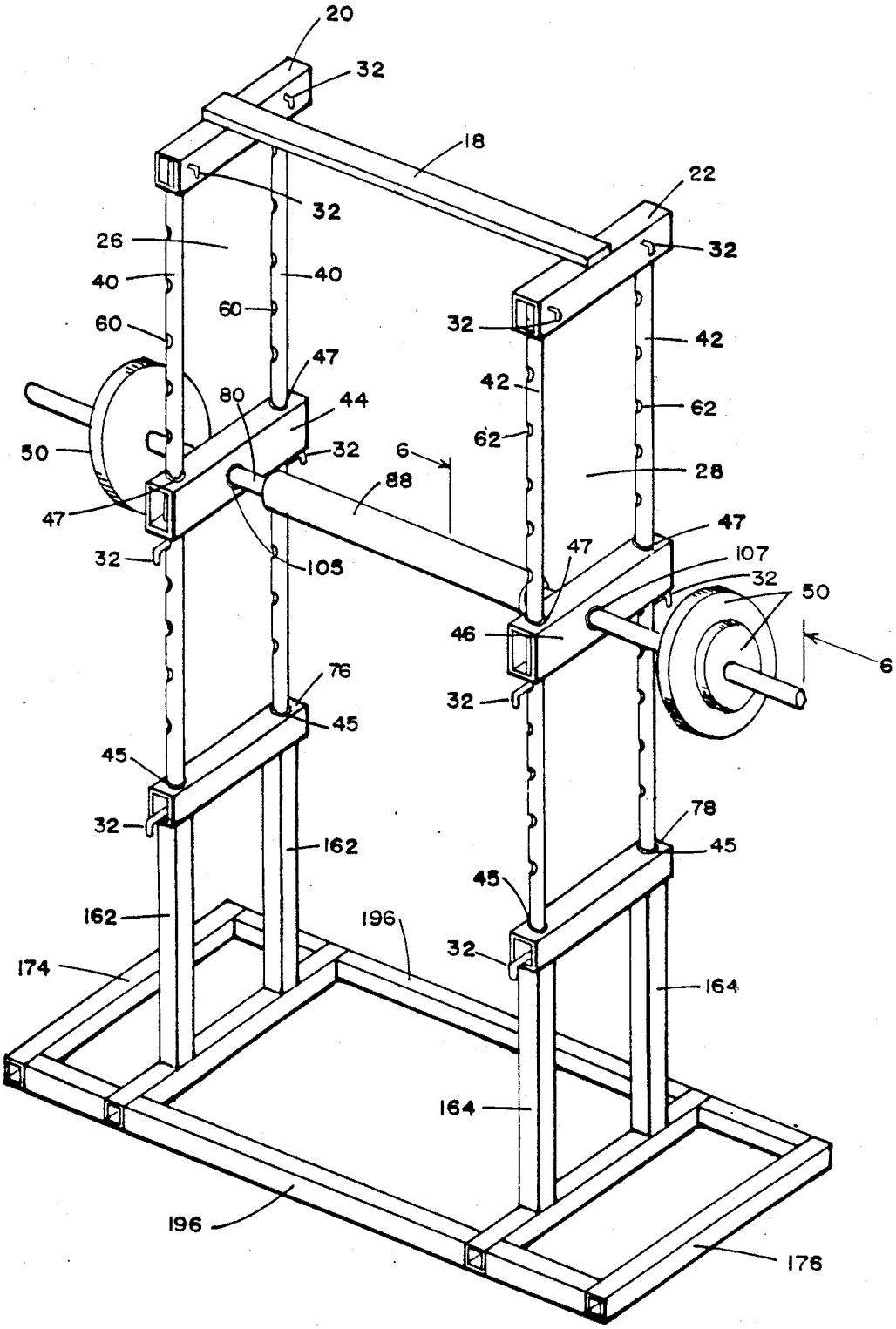
FIG. 10 is a perspective view of a third embodiment of the invention using a detachable barbell sleeve inserted over the weight bearing bar.
Figure 11:
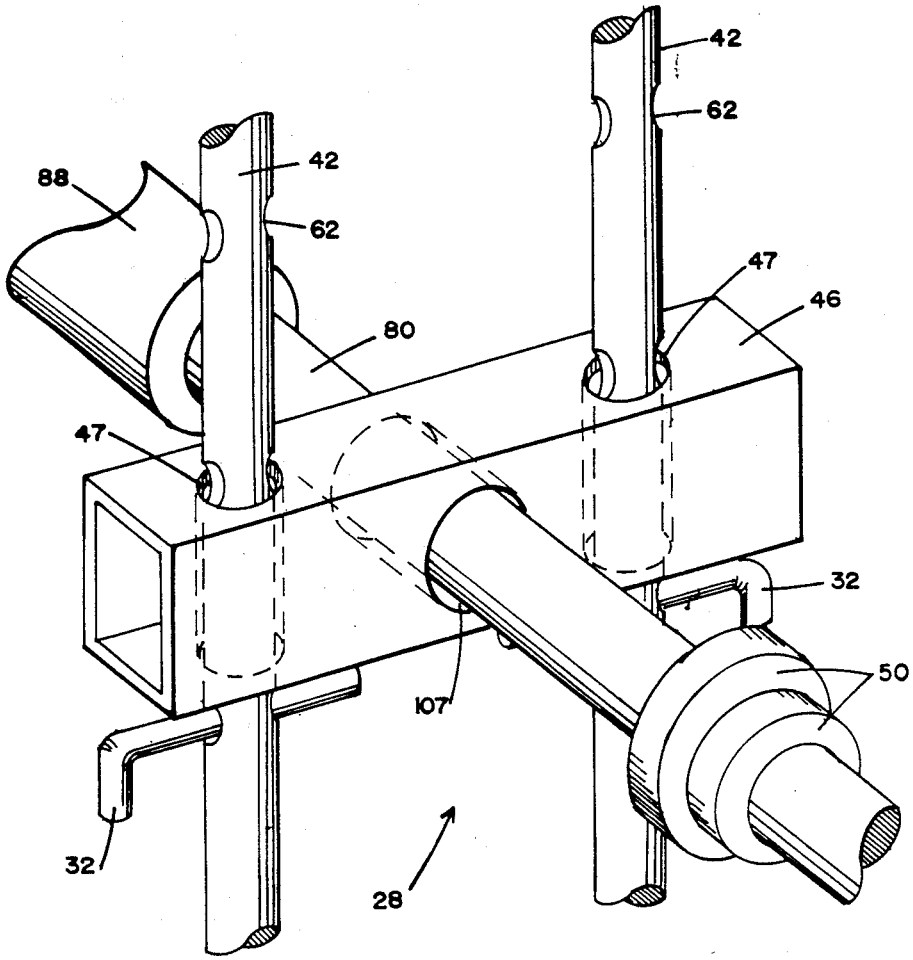
FIG. 11 is an enlarged view of the detachable barbell sleeve inserted over the weight bearing bar taken partly along the plane of line 6—6 FIG. 10.

Another optional use of the apparatus as shown in FIG. 10 and FIG. 11 is that a detachable barbell sleeve 88 which has a much larger diameter than the diameter of the weight bearing bar 80 may be inserted over the weight bearing bar 80 to provide a wider hand grip for performing pressing exercises which will result in increased grip and forearm strength. The sleeve which is free to rotate around the weight bearing bar 80 allows the freedom of movement of the wrist, elbow and shoulder joints during the ascending pressing movements and the descending lowering movements of the weight bearing bar 80 therefore reducing stress on these joints. In the event a weight lifter determines to perform the squat exercise the detachable barbell sleeve 88 is inserted over the weight bearing bar 80 (see FIG. 10, FIG. 11). Generally a weight bearing bar containing selected weights is placed across the shoulders and back of the weight lifter which causes great discomfort to these areas of the body. The use of the detachable barbell sleeve 88 inserted over the weight bearing bar 80 provides a larger surface area over the shoulder and back area when the weight lifter performs the squat exercise. This reduces the pressure points on the shoulder and back area when the weight bearing bar 80 containing the weight bearing bar sleeve 88 and the selected weights plates 50 is placed on shoulder and back area of the weight lifter. Another noteworthy structural feature of this apparatus as shown in FIG. 9 is that the upper transverse bar 18 which connects the pair of upper longitudinally extending support members 20 and 22 also mounts the upper pulley support member 98 containing pulley 125. Entrained over the pulley 125 is the cable 140 which is shown in FIG. 9 and is attached at one end to eye hook 152, which in turn is connected to the weight bearing bar 80. The cable's opposite end is attached to an eye hook 156 which is connected to the hand bar 180. Thus, various exercises may be performed by the weight lifter using the apparatus by grasping the hand bar 130 and pulling or pushing it downward to elevate the weight bearing bar 80 and the guide sleeve assemblies 44 and 46 and the weight plates 50 thereon. Also, the apparatus may be used in an optional mode in which the cable 140 extends downwardly and is entrained under a center swivel pulley 125 mounted to the lower pulley support member 110 which is attached to the lower transverse bar 196. The lower transverse bar 196 is in a parallel relation to the upper transverse bar 18 but spaced from the sides of vertical guide track support members 40—40 and 42—42 respectively. Thus, this arrangement allows various exercises which may be performed by pulling or pushing the hand bar 180 in an upward or downward movement.

A pull-up or chinning exercise may be performed on the upper transverse bar 18 by removing the weight bearing bar 80 and the upper pulley support member 98 containing the pulley 125.

As FIG. 1 shows, this new safety system for the free weight exercising apparatus is comprised of four distinct structural parts. The parts of the safety system are the two pairs of vertical guide track support members 40—40 and 42—42, the pair of guide sleeve assemblies 44 and 46, safety stop keys 32 and the coaxially aligned holes 60 and 62 in the vertical guide track support members 40—40 and 42—42 respectively which provide for height adjustment of the guide sleeve assemblies 44 and 46 and the weight bearing bar 80. With the safety stop keys 32 inserted into the desired coaxially aligned holes 60 and 62 of the vertical guide track support members 40—40 and 42—42 respectively, at a height optimally suited for the exercise, the integrity of the safety system is established prior to the start of any exercise thereby making the system nearly failsafe. The invention was also designed for safety with the placement of the weight plates 50 on the ends of the weight bearing bar 80 on the outside of the vertical guide track support members 40—40 and 42—42. If the weight plates should slide off the ends of the weight bearing bar 80 the weight plates 50 should drop to the floor on the outside of the two pairs of vertical guide track support members.

From the foregoing description it should be readily appreciated as shown in FIG. 1, FIG. 9 and FIG. 10 the inventive device 10 is adapted, both by its construction and operational mode, to permit a wide range of weightlifting exercises.

While this invention has been described in terms of preferred embodiment it will be clear to those skilled in the art that various alterations, modifications, permutations and rearrangements of the parts may be made without departing from the spirit and scope of the underlying inventive concept. A latitude of modifications, change and substitution is intended in the foregoing disclosure and in some instances some features of the invention will be employed without a corresponding use of other features, accordingly it is appropriate that the appended claims be interpreted as including such alterations, modifications, permutations and rearrangements as fall within the true spirit and scope of the invention herein.

What is claimed and desired to be protected by United States Letter Patent is:

1. A weightlifting apparatus for preventing injury to a weight lifter comprising:

a framework including a pair of laterally spaced base sections, an upright support brace mounted on each base section, a lower support member mounted on the top of each support brace, a pair of spaced vertical uprights comprising vertical track support guide members extending vertically upwardly from each lower support member, said vertical uprights having aligned apertures extending therethrough at regular intervals, an upper support member mounted to and extending between the upper end of each pair of vertical uprights, an upper transverse bar mounted to and extending between said upper support members, and a pair of lower transverse bars mounted to and extending between said base sections;

a pair of guide sleeves, each guide sleeve having a pair of apertures extending vertically through said guide sleeve, a guide sleeve being slidably mounted on each said pair of vertical uprights through said pair of apertures;

a weight bearing bar, each said guide sleeve having an aperture extending horizontally through the central portion thereof, said weight bearing bar being received in said horizontally extending aperture; and, a pair of safety stop keys being removably insertable in said aligned apertures extending through said vertical uprights;

whereby said safety keys may be inserted into said vertical uprights below the range of movement of the exercise such that the safety keys will prevent downward movement of the weight bearing bar below the range of movement of the exercise.

2. The weightlifting apparatus as recited in claim 1 wherein said upper transverse bar includes a pulley support member attachment having a pulley means, and wherein said weightlifting apparatus further comprises a handle bar, and an elongated cable entrained over said pulley means, said elongated cable being attached at one end to said handle bar and at its other end to said weight bearing bar means.

3. The weightlifting apparatus as recited in claim 2 wherein said lower transverse bar includes a second lower pulley support member attachment having said pulley means, and wherein said elongated cable is entrained over said first pulley is then entrained under said second pulley means and said elongated cable end is attached to said handle bar.

4. The weightlifting apparatus as recited in claim 1 wherein the weight bearing bar includes weight plates at each end thereof.

5. The weightlifting apparatus as recited in claim 1 further including a second pair of safety stop keys for removable insertion into said vertical uprights.

6. The weightlifting apparatus as recited in claim 1 further including a removable barbell sleeve over said weight bearing bar.

7. The weightlifting apparatus as recited in claim 1 wherein said upper transverse bar is a chin-up bar.

8. The weightlifting apparatus as recited in claim 1 wherein said vertical uprights are adjustably mounted on said lower support members to provide vertical height adjustment for said vertical track support guide members.

* * * * *